US005660537A

United States Patent [19]

Thompson

[11] Patent Number: 5,660,537

[45] Date of Patent: Aug. 26, 1997

[54] SELF-REGULATING FUEL SUPPLY PUMP

[75] Inventor: Robert H. Thompson, Redford, Mich.

[73] Assignee: Ford Motor Company, Dearborn, Mich.

[21] Appl. No.: 523,488

[22] Filed: Sep. 5, 1995

[51] Int. Cl.[6] ..... F04C 15/04

[52] U.S. Cl. ..... 418/28

[58] Field of Search ..... 418/28, 26

[56] References Cited

U.S. PATENT DOCUMENTS

| | | | |
|---|---|---|---|
| 1,659,753 | 2/1928 | Thompson . | |
| 2,517,862 | 8/1950 | Frederick . | |
| 2,581,160 | 1/1952 | Adams et al. . | |
| 3,109,381 | 11/1963 | Baker . | |
| 3,238,884 | 3/1966 | Wright . | |
| 3,460,480 | 8/1969 | Brownell | 418/28 |
| 3,520,223 | 7/1970 | Krawacki | 418/28 |
| 4,046,493 | 9/1977 | Ålund | 417/220 |
| 4,551,080 | 11/1985 | Geiger | 418/28 |
| 4,561,831 | 12/1985 | Mallen-Herrero | 418/28 |
| 4,758,137 | 7/1988 | Kieper | 418/28 X |
| 4,812,111 | 3/1989 | Thomas | 418/20 |
| 5,094,216 | 3/1992 | Miyaki et al. | 123/506 |

FOREIGN PATENT DOCUMENTS 2 193 761 8/1987 United Kingdom .

*Primary Examiner*—Richard E. Gluck
*Attorney, Agent, or Firm*—Neil P. Ferraro

[57] ABSTRACT

A self-regulating fuel supply pump for supplying fuel from a fuel tank to a fuel rail of an engine includes a housing having an inlet, an outlet, an inlet pressure chamber, a vane surplus chamber, a pumping chamber, an outlet pressure chamber, an inlet pressure passage, and an outlet pressure passage; a rotor drive shaft; a pressure regulation spring; a reference pressure piston; an outlet pressure piston; a vane seal; a cylindrical rotor; and vanes slip-mounted in the rotor. Fuel is drawn into the inlet by the rotor and vanes rotating on the rotor drive shaft within the pumping chamber and compressed by reducing vane width via the eccentric orientation of the rotor in the pumping chamber. Pressure regulation spring combines with reference pressure piston and outlet pressure piston to vary vane length according to the pressure differential between inlet pressure chamber and outlet pressure chamber, as provided by inlet pressure passage and outlet pressure passage. Surplus vane length is separated from pumping chamber by vane seal, through which rotor and vanes may slide.

8 Claims, 2 Drawing Sheets

SELF-REGULATING FUEL SUPPLY PUMP

FIELD OF THE INVENTION

The present invention relates to fuel supply pumps, and, more particularly, to a self-regulating fuel supply pump for supplying fuel to an engine.

DESCRIPTION OF THE RELATED ART

Historically, fuel supply pumps have been operated to provide a constant volumetric flow rate of fuel to an engine. This volumetric flow rate was selected to provide the maximum quantity of fuel necessary under maximum power engine operating conditions. However, since engine operating conditions rarely needed the maximum quantity, much of the pumped fuel was not utilized by the engine and thus had to be returned to the fuel tank. This function was controlled by a pressure regulator between the fuel supply line and the fuel rail of the engine, which maintained fuel rail pressure by shunting unnecessary fuel into a fuel return line, which carried the fuel back to the fuel tank.

Since fuel increased in temperature as it reached the engine, returning fuel to the tank potentially lead to increases in vapor, which reduced system efficiency. Additionally, since it required energy to pump fuel from the tank, spending energy to pump fuel that was ultimately returned to the tank was also inefficient.

To address these and other issues, the returnless fuel system was conceived, including both mechanical and electrical variants. In general, the electrical returnless fuel systems eliminated the need to return unused fuel by varying the duty cycle of the fuel pump, such that the pump operated to produce a variety of volumetric flow rates according to engine demand. While successful, it required additional electronic components and increased system complexity. By contrast, the mechanical returnless fuel systems were generally less complex. Essentially, they merely moved the pressure regulator of the conventional system into the fuel tank, eliminating the returnless fuel line between the engine and the fuel tank. While successful, they generally did not address the inefficiencies associated with requiring the fuel pump to pump more fuel than was actually necessary to supply the engine under present operating conditions.

It would thus be desirable to have a fuel supply pump which overcomes the aforementioned difficulties.

SUMMARY OF THE INVENTION

A self-regulating fuel supply pump for supplying fuel from a fuel tank to a fuel rail of an engine includes a housing having an inlet, an outlet, an inlet pressure chamber, a vane surplus chamber, a pumping chamber, an outlet pressure chamber, an inlet pressure passage, and an outlet pressure passage; a rotor drive shaft; a pressure regulation spring; a reference pressure piston; an outlet pressure piston; a vane seal; a cylindrical rotor; and vanes slip-mounted in the rotor. Fuel is drawn into the inlet by the rotor and vanes rotating on the rotor drive shaft within the pumping chamber and compressed by reducing vane width via the eccentric orientation of the rotor in the pumping chamber. Pressure regulation spring combines with reference pressure piston and outlet pressure piston to vary vane length according to the pressure differential between inlet pressure chamber and outlet pressure chamber, as provided by inlet pressure passage and outlet pressure passage. Surplus vane length is separated from pumping chamber by vane seal, through which rotor and vanes may slide.

A primary object of the present invention is to provide a new and improved apparatus for supplying fuel to a fuel rail in a returnless fuel system. More specifically, it is an object of the present invention to vary the output flow rate of the fuel pump in response to engine demand by varying the length of the rotor and vanes in the fuel pump.

A primary advantage of this invention is that it minimizes heat input to the fuel by varying the load of the drive motor with fuel demand. An additional advantage is that it eliminates bypass fuel flow, reducing vapor generation and fuel turbulence. A further advantage is that fuel system noise is reduced because the fuel pump load is reduced under low fuel demand conditions.

Other objects, features, and advantages will be apparent from a study of the following written description and drawings.

DETAILED DESCRIPTION OF THE PREFERRED EMBODIMENTS

Figure 1:
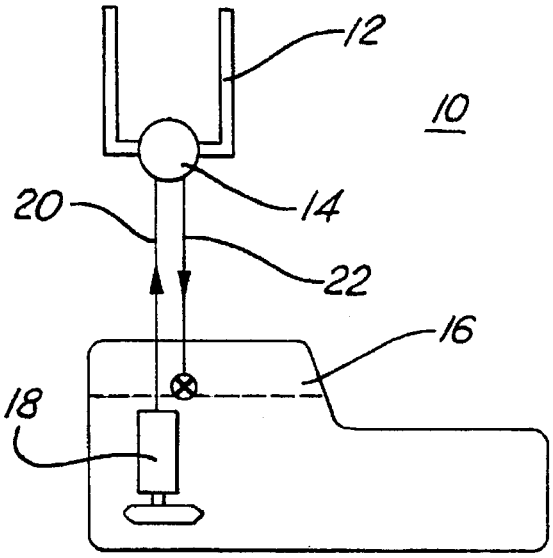
(PRIOR ART) FIG.1
FIG. 1 shows a conventional fuel supply system according to the prior art.

Referring now to FIG. 1*a* conventional fuel supply system 10 according to the prior art includes a fuel rail 12 for supplying fuel to an engine (not shown), connected to a pressure regulator 14 for maintaining a relatively constant pressure in fuel rail 12. Fuel supply line 20 supplies fuel pumped by a constant flow fuel pump 18 to pressure regulator 14, which sends unneeded fuel back through fuel return line 22 to fuel tank 16. Note that fuel returned in return line 22 is generally hotter than fuel supplied through fuel supply line 20, having been heated by its proximity to the engine.

Figure 2:
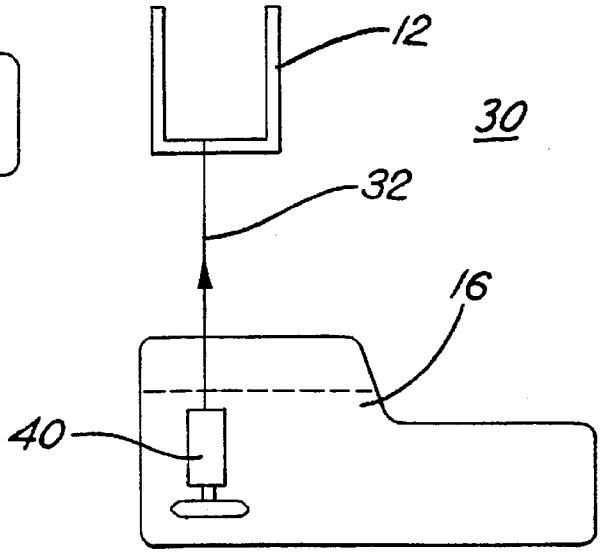
FIG. 2 shows a returnless fuel supply system using a self-regulating fuel pump according to the present invention.

Referring now to FIG. 2, a returnless fuel supply system 30 using a self-regulating fuel supply pump 40 according to the present invention includes a fuel tank 16, with self-regulating fuel supply pump 40 mounted within the tank. A fuel supply line 32 supplies fuel to a fuel rail 12 for use by an engine (not shown). In contrast to the system of FIG. 1, there is no need for either a return line or a pressure regulator, as the self-regulating fuel pump varies its output to maintain the necessary pressure in the fuel rail.

Figure 3:
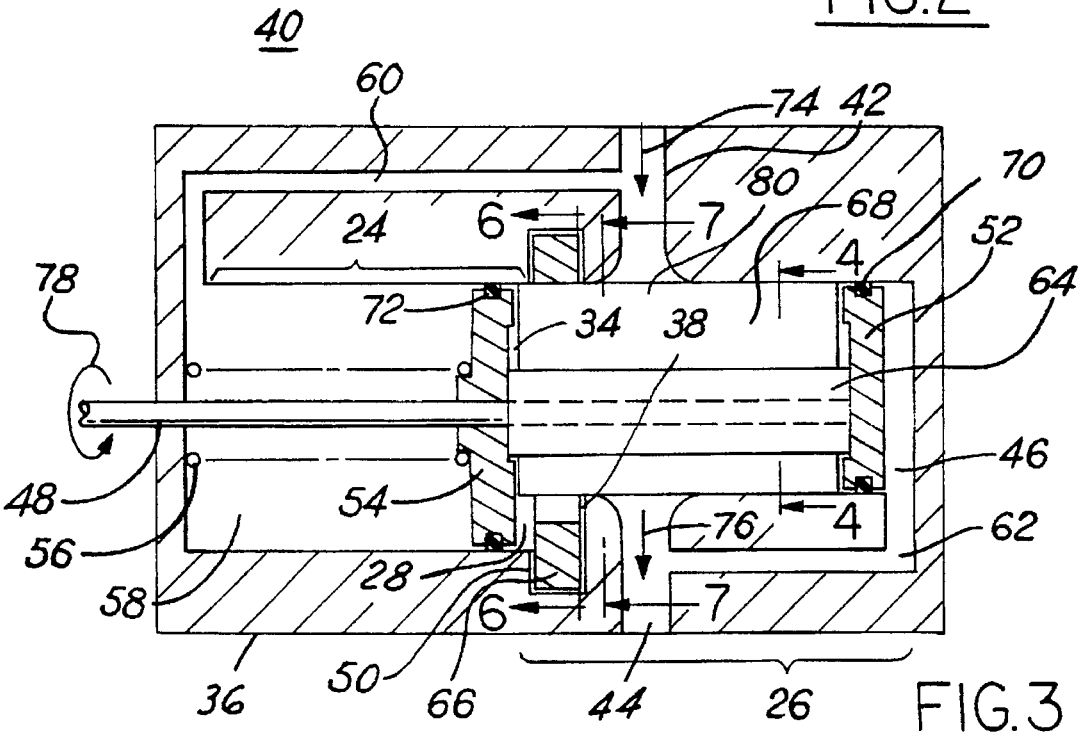
FIG. 3 is a diagram of a self-regulating fuel supply pump according to the present invention.

Referring now to FIG. 3, a preferred embodiment of a self-regulating fuel supply pump 40 according to the present invention begins with a housing designated generally 36. Housing 36 is essentially a series of cylinders with varying diameters and lengths, and includes a reference portion 24, a pumping portion 26, and a vane seal containment portion 50 therebetween. Vane seal containment portion 50 is adjacent to and axially aligned with reference portion 24 and of slightly greater diameter. Pumping portion 26 is axially offset such that an edge of pumping portion 26 is aligned with reference portion 24. Pumping portion 26 is of lesser diameter than reference portion 24. Housing 36 also has an inlet 42 for admitting low pressure fuel connected to pumping portion 26, an outlet 44 for providing high pressure fuel to fuel rail 12 connected to pumping portion 26, an inlet pressure passage 60 connecting inlet 42 to reference portion 24, and an outlet pressure passage 62 connecting outlet 44 to pumping portion 26.

A rotor drive shaft 48 is driven by a motor (not shown) and extends throughout housing 36 in axial alignment with reference portion 24. Rotor drive shaft 48 is splined or otherwise characterized so as transmit rotational motion to parts mounted thereupon while permitting such parts to translate along the length of rotor drive shaft 48. A pressure regulation spring 56 shown as a cut-away is mounted within reference portion 24 against an outside wall through which rotor drive shaft 48 extends. Pressure regulation spring 56 extends within reference portion 24 about but not touching rotor drive shaft 48 and presses against reference pressure piston 54. Reference pressure piston 54 is of a circular cross-section and substantially fills a cross-section of reference portion 24. Reference pressure piston seal 72 extends around reference pressure piston 54, effectively separating reference portion into an inlet pressure chamber 58 which communicates with inlet pressure passage 60 and a vane surplus chamber 34.

Figure 7:
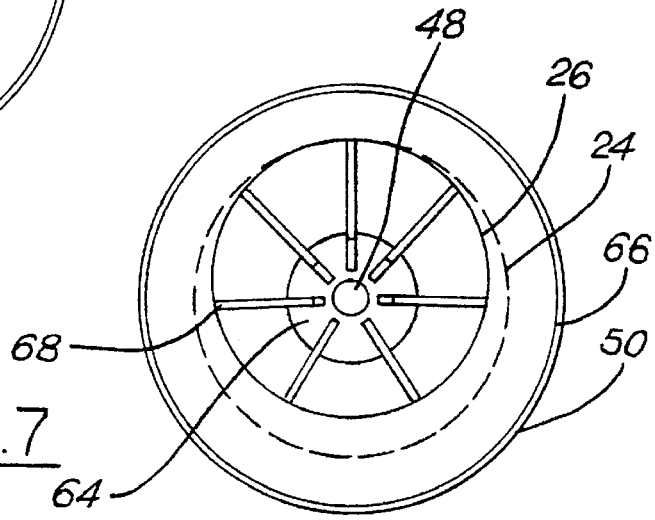
FIG. 7 is an axial view of a self-regulating fuel supply pump taken along line 7—7 of FIG. 3 showing the relationship between internal pump components.

A cylindrical rotor 64 extends about rotor drive shaft 48 and is mounted thereupon so as to rotate within pumping portion 26. Since pumping portion 26 is not axially aligned with reference portion 24, rotor 64 rotates in an eccentric fashion with respect to the diameter of pumping portion 26. Slip vanes 68 extend radially along the outer surface of rotor 64 and are installed in slots within rotor 64 such that the width of each vane 68 varies throughout a single rotation as dictated by the eccentric relationship between rotor 64 and pumping portion 26. FIG. 7 details the axial relationship between pumping portion 26, reference portion 24, and vane seal containment portion 50, reflecting this eccentricity.

Continuing with FIG. 3, an outlet pressure piston 52 of circular cross-section substantially fills a cross-sectional area of pumping portion 26. Outlet pressure piston seal 70 extends around outlet pressure piston 52, effectively separating pumping portion 26 into two chambers, an outlet pressure chamber 46 which communicates with outlet pressure passage 62 and a pumping chamber 80 which communicates with both inlet 42 and outlet 44. A vane seal 66 extends about vanes 68 and rotor 64, separating pumping chamber 80 from vane surplus chamber 34. Vane seal 66 is of slightly larger diameter than either pumping portion 26 or reference portion 24 and is located within vane seal containment portion 50, from which it cannot escape due to its greater diameter. Vane seal 66 rotates with rotor 64 and vanes 68 while permitting them to slide axially through vane seal 66, effectively altering the relative sizes of vane surplus chamber 34 and pumping chamber 80. A bypass channel 28 is located within reference portion 24 between vane seal 66 and reference pressure piston 54 for receiving fuel which may escape through vane seal 66 into vane surplus chamber 34 due to the slipping of vanes 68 caused by axial eccentricity, as detailed in FIG. 4.

With reference to FIG. 3, the self-regulating fuel supply pump 40 operates as follows. Fuel from inlet 42 travels into pumping chamber 80 according to arrow 74, where rotor 64 and vanes 68 are rotated as noted by arrow 78 by rotor drive shaft 48, which is driven by a motor (not shown). Rotor 64 and vanes 68 carry fuel from inlet 42 to outlet 44. During this journey, the pressure of the fuel increases because the eccentricity of rotor 64 and vanes 68 with respect to pumping portion 26 causes vanes 68 to slip into rotor 64, becoming more narrow and thereby forces the fuel out outlet 44, flowing outward as denoted by arrow 76 into fuel supply line 32 of FIG. 2. Continuing with FIG. 3, through inlet pressure passage 60, the pressure of the fuel at inlet 42 is provided on one side of reference pressure piston 54. Through outlet pressure passage 62, the pressure of the fuel at outlet 44 is provided on one side of outlet pressure piston 52. Rotor 64 and vanes 68 are disposed between pistons 54, 52 such that translations of the pistons within the chamber, caused by pressure differences between inlet 42 and outlet 44, force rotor 64 and vanes 68 to translate along the axis of rotor drive shaft 48, sliding rotor 64 and vanes 68 through vane seal 66 and decreasing or increasing the length of vane remaining within pumping chamber 80. Since the outlet flow from pumping chamber 80 is the product of swept area, angular velocity, and vane length, altering the length of vanes 68 will alter the flow rate in direct proportion thereto, accordingly decreasing or increasing the flow rate of fuel provided to the engine through outlet 44.

Positioning of pistons 52, 54 within housing 36 is determined by the relationship between inlet and outlet pressure, which is governed in part by pressure regulation spring 56. The spring constant of pressure regulation spring 56 times displacement of spring 56 divided by the area of reference pressure piston 54 equals the pressure in vane surplus chamber 34 necessary to displace reference piston against spring 56. Similarly, since pressure is normal force applied over area, the pressure required in outlet pressure chamber 46 to overcome the resistance of spring 56 and reference pressure piston 54 can be selected by controlling the area of outlet pressure piston 52. Hence pressure regulation spring 56 and pistons 52, 54 are selected to provide a constant desirable pressure differential between inlet 42 and outlet 44 of, for example, 55 psi, for which a length of vanes 68 is selected. If outlet pressure increases beyond the set point, such as happens when, for example, a driver closes the throttle, thereby reducing fuel demand, the increased pressure at outlet 44 is reflected within outlet pressure chamber 46 by means of outlet pressure passage 62. This causes outlet pressure piston 52 to overcome the resistance of spring 56 as reflected by reference pressure piston 54, forcing rotor 64 and vanes 68 to slide through vane seal 66, effectively reducing the length of vanes 68 and the volume of pumping chamber 80, while increasing the volume of vane surplus chamber 34. Self-regulating fuel supply pump 40 thus reduces the flow rate, which restores the differential pressure to a constant value, as desired. Recall that since outlet flow is the product of swept area, angular velocity, and vane length, altering the length of the vanes will alter the flow rate in direct proportion thereto.

Figure 4:
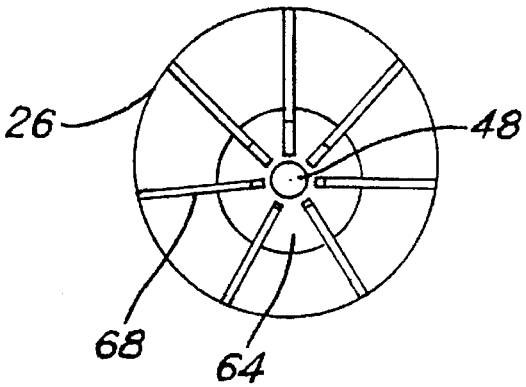
FIG. 4 is a cross-section of the pumping chamber of a self-regulating fuel supply pump, taken along line 4—4 of FIG. 3.

Referring now to FIG. 4, a cross-section of pumping portion 26 of self-regulating fuel supply pump 40, taken along line 4—4 of FIG. 3, demonstrates the eccentricity of rotor 64 with respect to pumping portion 26. The wall of pumping portion 26 is shown to be circular. Rotor drive shaft 64 intersects the plane of pumping portion 26 at a non-central point. Circular rotor 64 is mounted on rotor drive shaft 48 and is of less diameter than that of pumping portion 26. Vanes 68 are slipped within slots in rotor 64. The length of each vane 68 is instantaneously determined by the proximity of the wall of pumping portion 26 with respect to that portion of rotor 64 in which the vane 68 is slipped. While rotating, centrifugal force urges vanes 68 outward from rotor 64 to the maximum length permitted by proximity of the pumping portion 26.

Figure 5:
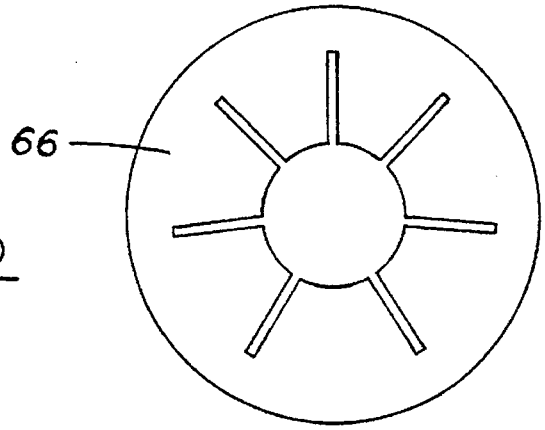
FIG. 5 is a vane seal for a self-regulating fuel supply pump.

Referring now to FIG. 5, a preferred embodiment of a circular vane seal 66 for a self-regulating fuel supply pump 40 has a cut-out in the shape of the vane 68 and rotor 64 profile. While this illustrates a system having seven vanes 68, more or less vanes 68 could be used as desired. Note that the axis of rotation for rotor 64 is in the geometric center of vane seal 66. Note also that the length of the cut out for each vane 68 is set to the maximum possible extension of the vane 68 from the rotor 64.

Figure 6:
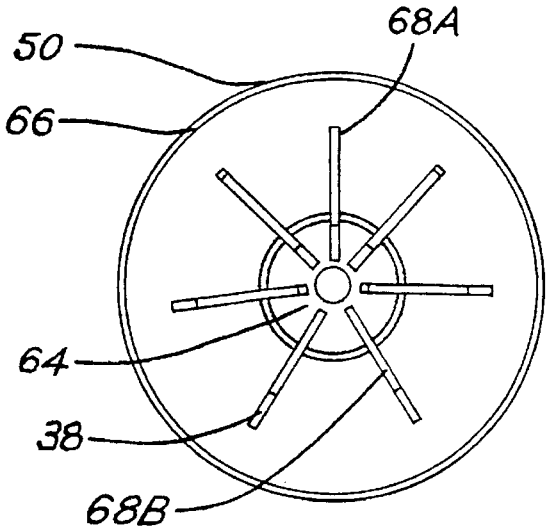
FIG. 6 is a cross-section of the vane seal compartment of a self-regulating fuel supply pump, taken along line 6—6 of FIG. 3.

Referring now to FIG. 6, a cross-section of the vane seal compartment of a self-regulating fuel supply pump, taken along line 7–7 of FIG. 3, shows a vane seal 66 engaged with rotor 64 and vanes 68. Note the effect of the eccentric relationship between rotor 64 and pumping portion 26. Due to the influence of pumping portion 26 on the width of vanes 68, some vanes 68A are fully extended at one point in the rotation cycle while other vanes 68B are recessed, leaving a temporary (FIG. 3). Gap 38 occurs coincident with bypass channel 28, shown in FIG. 3, which minimizes pumping losses associated with leaking between vane seal 66, rotor 64 and vanes 68. The wall of vane seal containment portion 50 is of slightly greater diameter than vane seal 66, permitting seal 66 to rotate freely with rotor 64 and vanes 68.

Referring now to FIG. 7, an axial view of self-regulating fuel supply pump 40 taken along arrow 7 of FIG. 3 shows the geometric relationship between the major internal pump components. Rotor drive shaft 48 extends through the center of rotor 64. Vanes 68 are slipped into slots in rotor 64 such that their width may be varied according to the eccentric relationship between pumping portion 26 and rotor 64. The outer surface of reference portion 24 is shown as a dotted line, because it would not ordinarily be visible in this view. Reference chamber 24 has diameter greater than that of pumping portion 26 but less than that of vane seal containment portion 50 and vane seal 66. This prevents vane seal 66 from translating with lateral translations of rotor 64 and vanes 68 along rotor drive shaft 48. Note also that rotor drive shaft 48 is geometrically centered with respect to rotor 48, vane seal containment portion 50, vane seal 66, and reference chamber 24. Only pumping portion 26 is not in axial alignment with rotor drive shaft 48, in order to provide the desired slip pumping effect with the vanes.

From the foregoing description, one ordinarily skilled in the art can easily ascertain the essential characteristics of this invention and, without departing from the spirit and scope of the claims, can make various changes and modifications to the invention to adapt it to various uses and conditions.

We claim:

1. A self-regulating fuel supply pump comprising:

a housing having first and second ends, an inlet pressure chamber, a vane surplus chamber adjacent the inlet pressure chamber, a pumping chamber adjacent the vane surplus chamber, an outlet pressure chamber between the vane surplus chamber and the second end, an inlet extending into the pumping chamber, an inlet pressure passage between the inlet and the inlet pressure chamber, an outlet extending into the pumping chamber, and an outlet pressure passage between the outlet and the outlet pressure chamber;

a rotor drive shaft coupled through said housing between the first and second housing ends;

a pressure regulation spring having first and second spring ends, said spring being disposed about said rotor drive shaft within the inlet pressure chamber, the first spring end resting against the first housing end;

a reference pressure piston separating the inlet pressure chamber from the vane surplus chamber and resting against the second spring end;

an outlet pressure piston separating the pumping chamber from the outlet pressure chamber;

a vane seal substantially filling a cross-sectional area of the housing within the vane surplus chamber, said vane seal being of greater diameter than both the inlet pressure chamber and said vane surplus chamber;

a cylindrical rotor within the pumping chamber and the vane surplus chamber between said reference pressure piston and said outlet pressure piston, said rotor being axially mounted on and rotated by said rotor drive shaft while being freely translatable therealong;

and a plurality of vanes arranged along a length of an outer cylindrical surface of said rotor, said vanes being slip-mounted in said rotor, wherein said vane seal is slidably disposed about said rotor and said vanes to permit said rotor and said vanes to slide through said vane seal and along said rotor drive shaft according to movement of said inlet pressure piston and said outlet pressure piston.

2. The fuel supply pump of claim 1, further comprising a bypass channel within the vane surplus chamber formed by said reference pressure piston, said housing, said vane seal, said vanes, and said rotor, said bypass channel being of varying volume.

3. The fuel supply pump of claim 1, further comprising an outlet pressure piston seal between said outlet pressure piston and housing.

4. The fuel supply pump of claim 1, further comprising a reference pressure piston seal between said reference pressure piston and said housing.

5. A self-regulating fuel supply pump for supplying fuel from a fuel tank to a fuel rail of an engine, comprising:

a housing having a cylindrical reference portion, a cylindrical vane seal containment portion adjacent to the reference portion, the vane seal containment portion being of greater diameter than and having a common axis with the reference portion, a cylindrical pumping portion adjacent to the vane seal containment portion on a side opposite the reference portion, the pumping portion having a lesser diameter than and being aligned along an edge with the reference portion, a first housing end adjacent to the reference portion, a second housing end adjacent the pumping portion, an inlet pressure chamber adjacent the first housing end and inside the reference portion, a vane surplus chamber adjacent the inlet pressure chamber and inside the reference portion, a pumping chamber disposed within the pumping portion, an outlet pressure chamber disposed between the pumping chamber and the second housing end and being disposed within the pumping portion, an inlet disposed along an outer wall of the pumping chamber for receiving fuel from the fuel tank, an inlet pressure passage connecting said inlet with said reference portion, an outlet disposed along an outer wall of the pumping chamber, and an outlet pressure passage connecting the outlet with the outlet pressure chamber;

a rotor drive shaft extending axially through the center of the first housing end, the reference portion, and the vane seal containment portion, and extending non-axially through the pumping portion to the second housing end;

a pressure regulation spring contained within the reference portion having first and second spring ends and being disposed about said rotor drive shaft, wherein said first spring end rests against the first housing end;

a reference pressure piston contained within the reference portion and disposed against the second spring end, said reference pressure piston substantially filling a cross-sectional area of the reference portion perpendicular to the axis of the reference portion and separating the inlet pressure chamber from the vane surplus chamber;

an outlet pressure piston contained within the pumping portion and substantially filling a cross-sectional area of the pumping portion perpendicular to an axis of the pumping portion, said outlet pressure piston separating the pumping chamber from the outlet pressure chamber;

a vane seal disposed within the vane seal containment portion and substantially filling a cross-sectional area of the vane seal containment portion, said vane seal being of greater diameter than both said reference portion and said vane seal containment portion;

a cylindrical rotor housed within the housing between said reference pressure piston and said outlet pressure piston, said rotor being axially mounted on and rotated by said rotor drive shaft while being freely translatable therealong;

and a plurality of vanes arranged along a length of an outer cylindrical surface of said rotor, said vanes being slip-mounted in said rotor, wherein said vane seal is slidably disposed about said rotor and said vanes to permit said rotor and said vanes to slide through said vane seal and along said rotor drive shaft according to movement of said reference pressure piston and said outlet pressure piston.

6. The fuel supply pump of claim 5, further comprising a bypass channel within the vane surplus chamber formed by said reference pressure piston, an outer wall of the reference portion, said vane seal, said vanes, and said rotor, said bypass channel being of varying volume.

7. The fuel supply pump of claim 5, further comprising an outlet pressure piston seal between said outlet pressure piston and said pumping portion.

8. The fuel supply pump of claim 5, further comprising a reference pressure piston seal between said reference pressure piston and said reference portion.

* * * * *